United States Patent [19]

Williams

[11] 4,300,961

[45] Nov. 17, 1981

[54] PROCESS FOR DETERRENT COATING OF TRIPLE BASE PROPELLANT COMPOSITIONS

[75] Inventor: Rafelix A. Williams, Radford, Va.

[73] Assignee: Hercules Incorporated, Wilmington, Del.

[21] Appl. No.: 144,142

[22] Filed: Apr. 28, 1980

[51] Int. Cl.[3] ..... G06B 45/28

[52] U.S. Cl. ..... 149/10; 149/11; 149/98; 149/109.6

[58] Field of Search ..... 149/10, 11, 98, 109.6

[56] References Cited

U.S. PATENT DOCUMENTS 3,704,185 11/1972 Cooner ..... 149/11

*Primary Examiner*—Stephen J. Lechert, Jr.

*Attorney, Agent, or Firm*—Michael B. Keehan

[57] ABSTRACT

A process is provided for deterrent coating of propellant compositions useful as gun propellant in which the propellant contains nitrocellulose, nitroglycerin and nitroguanidine. In the process strands of propellant containing processing solvents are coated with burning rate deterrent on the exterior surface of the strand only. The strands are cut and dried. The process reduces exposure of the propellant to heat by elimination of the preliminary drying step to remove processing solvents prior to deterrent coating. Ethyl alcohol is the preferred processing solvent.

4 Claims, 2 Drawing Figures

PROCESS FOR DETERRENT COATING OF TRIPLE BASE PROPELLANT COMPOSITIONS

Figure 1:
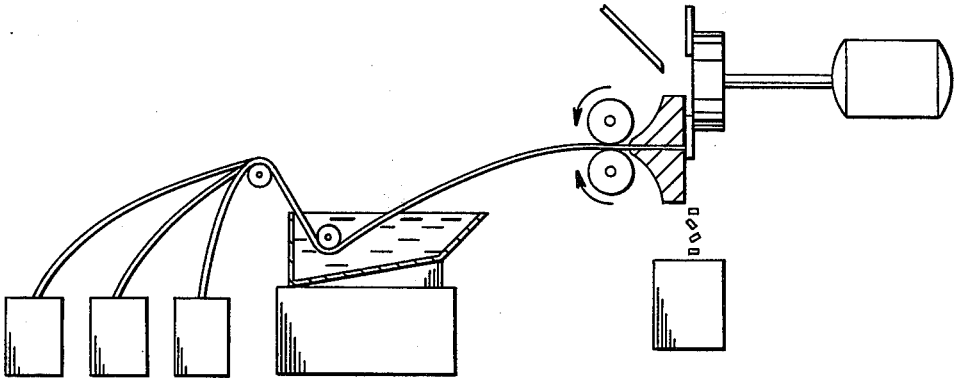

This invention relates to a process for coating of propellant strands with burning rate deterrents for the purpose of preparing progressive burning rate propellant powder suitable for use as the propellant charge for ammunition.

PRIOR ART AND BACKGROUND

Progressive burning propellants suitable for use as the propellant powder for selected ammunition are generally prepared by adding an organic material, which is a gelatinizing agent for the nitrocellulose component of the propellant, to the propellant granules and tumbling said mixture in a rotating barrel which is heated above the melting point of the added organic material. The organic material becomes fluid upon heating and coats the powder. During the coating operation the mixture is usually wet with water. Water may be added directly to the rotating barrel or may be supplied in the form of condensed steam during heat-up of the organic coating material. This coating technique is satisfactory for use with propellants which are of the single base or double base type, i.e., propellants consisting essentially of nitrocellulose and an explosive plasticizer such as nitroglycerin. This coating technique is not satisfactory for use with propellant powder which contains in addition to nitrocellulose and explosive plasticizer, water-soluble components, e.g., nitroguanidine, or other water-soluble materials. When propellants containing nitroguanidine are coated in the presence of water or organic liquids water-soluble components such as nitroguanidine are leached out of the propellant composition and the burning characteristics of the propellant powder are adversely affected.

U.S. Pat. No. 2,992,911 discloses a process for coating the surface of nitroguanidine containing propellant powder for the purpose of preparing progressive burning propellant compositions. In accordance with the teachings of this patent, the surface of propellant powder comprising nitrocellulose, nitroglycerin and nitroguanidine is coated with a burning rate deterrent composition, said process comprising treating the powder surface with symmetrical diethyl diphenyl urea in a quantity sufficient to form a chemical complex in situ by interaction of the diethyl diphenyl urea with said nitroguanidine in a zone of inwardly diminishing concentration in the neighborhood of the surface only of said propellant powder. In practice, the diethyl diphenyl urea is dissolved in a nonsolvent for nitrocellulose such as ethyl alcohol and the resulting solution is sprayed on the powder in a rotating pan or barrel. The resulting surface modified propellant powder has progressive burning characteristics. The ballistic properties of such propellant powder are said to be substantially unaltered after storage at 65° C. for six months.

U.S. Pat. No. 3,743,554 discloses a method of deterrent coating of smokeless powder employing certain linear polyesters as the burning rate deterrent medium. In the process described in this patent, smokeless powder is agitated in a mixing tank in the presence of water containing approximately 2% of the polyester deterrent coating material. The deterrent coating material is added as a solution in methylene chloride solvent. After addition of the deterrent coating material to the mixing tank the resulting suspension is heated to 85°-90° C. for at least 30 minutes. At the end of the thirty minute period the coating of the smokeless powder is complete. The linear polyester burning rate deterrent materials employed in U.S. Pat. No. 3,743,554 are formed by reaction of dihydric alcohol components such as ethylene glycol, polyethylene glycol, propylene glycol, propylene polypropylene glycol and neopentyl glycol, and the like with dibasic acid components such as adipic acid, azaleic acid, phthalic acid and sebacic acid and the like. The polyester materials have a weight average molecular weight of from about 1,500 to about 30,000 and a melting point not exceeding about 190° F.

German OLS No. 2,060,052, published June 8, 1972, discloses a process for preparing progressive burning propellant powder by surface treating powder strands with desensitizing materials prior to cutting to final dimensions so that only external surfaces of strands are desensitized. In the process disclosed, solvent containing powder strands are passed vertically through compartments in which surface treatment is carried out by a spraying operation. The strands may be partially dried prior to entrance into the spraying compartments. It is also suggested that surface treatment can be conducted by drawing elongated powder strands through appropriate solutions.

SUMMARY OF THE INVENTION

In accordance with this invention a process is provided in which solvent-wet propellant strands coming directly from the extrusion step in the propellant manufacturing process are surface treated with burning rate deterrent prior to drying of the strands to remove processing solvents. The propellant compositions to which the process of this invention pertains are triple base compositions containing nitroguanidine in addition to nitrocellulose and a nitrate ester plasticizer such as nitroglycerin. In the process of this invention solvent-wet propellant strands of composition described are contacted with nonaqueous solutions of burning rate deterrents for a time and at a temperature sufficient for the deterrent to penetrate into the strand surface. Promptly after contact with the burning rate deterrent the surface of the propellant is washed with water to remove burning rate deterrent solution on the surface of the propellant. The propellant strands are cut and the propellant is dried.

Illustrative burning rate deterrents which can be applied to the external surface of a solvent-wet propellant strand in accordance with this invention include dimethyl diphenyl urea (methylcentralite), diethyl diphenyl urea (ethylcentralite), ethylene dimethacrylate, lead-2-ethyl hexoate, linear polyesters, and the like, which deterrents are capable of diffusing into said propellant strand. The linear polyesters which can be employed have a weight average molecular weight of from about 1,500 to about 30,000, a melting point not exceeding 190° F. and being substantially nonmigrating within said propellant strand at temperatures not exceeding 150° F. Linear polyesters that can be employed are more specifically disclosed in U.S. Pat. No. 3,743,554 and such disclosure is incorporated herein by reference.

In the process of this invention, the solvents which can be employed for the burning rate deterrents must be nonaqueous and nonsolvents at the temperature of use for nitrocellulose and nitroguanidine and solvents or dispersants for the burning rate deterrents. The term solvent is used herein with respect to burning rate deterrents to mean solvent, partial solvent and dispersant.

Suitable solvents for dimethyl diphenyl urea, diethyl diphenyl urea and ethylene dimethacrylate include ethyl alcohol and ethyl ether. A suitable solvent for lead-2-ethyl hexoate is ethyl ether. A suitable solvent for the polyester resins is methylene chloride. Other solvents meeting the above requirements can be employed. Other properties of solvents that are advantageous are those of being wetting agents and being readily removable by means of water affinity and/or heat. The preferred solvents for use in the process of this invention are methyl alcohol, ethyl alcohol, n-propyl and isopropyl alcohol, n-butyl and isobutyl alcohol. The most preferred solvent is ethyl alcohol.

In the process of this invention, the burning rate deterrent is applied in amounts of from about 0.2% to about 4% by weight based on the weight of the propellant compositions. The percentage of burning rate deterrent penetrating the surface of the propellant strands is controlled by the contact time of the propellant strand with the mixture of burning rate deterrent and solvent and the concentration of the burning rate deterrent in the mixture. Propellant strands can be contacted with burning rate deterrent by any suitable means such as passing a strand of propellant through a bath containing the burning rate deterrent and solvent. Coiled strands of propellants, except for the ends of the strands, can be immersed in a mixture of burning rate deterrent and solvent. The residence time of a strand of propellant within a mixture of burning rate deterrent and solvent to achieve a desired level of deterrent coating depends on the temperature of the mixture, residence times being shorter at higher temperatures. Ambient temperatures or above are suitable for the deterrent coating step and can vary depending on the deterrent material employed.

The process of this invention is designed for coating the outside surface of the propellant strand only. When immersing perforated strands, care must be taken to avoid permitting the ends of the strands to be immersed in the mixture of burning rate deterrent. Following immersion, the strands are promptly rinsed with water to effect removal of excess burning rate deterrent and solvent. Water washing can take place prior to or after cutting as long as the washing is completed promptly, i.e., within a minute and preferably within several seconds from the time the strand is removed from the bath containing the burning rate deterrent.

In FIG. 1 the preferred embodiment of the process of this invention is illustrated. The strands of propellant are continuously passed through a coating bath and directly into a cutting machine and then washed. Alternatively, the strands can be immersed in a mixture of burning rate deterrent and solvent, removed from the immersion vessel, rinsed with water and subsequently cut to length and dried to prepare propellant grains. When the solvent employed with the burning rate deterrent is a complete solvent for the deterrent, the solutions of burning rate deterrent should be prepared sufficiently in advance of coating operations to permit complete solution equilibrium to be reached at room temperature so that a saturated solution is achieved.

The following examples further illustrate this invention. In the examples and throughout this specification percentages and parts are by weight unless otherwise specified.

EXAMPLES 1 and 2

A propellant composition was prepared by conventional propellant manufacturing methods employing ethyl alcohol and acetone as processing solvents. The propellant was mixed in a sigma blade mixer, blocked in a blocking press and extruded into tubular strands. The propellant composition (excluding solvents) is set forth in Table 1. A solvent-wet propellant strand prepared by said process is next passed through a solution comprising 33% diethyl diphenyl urea and 66% ethyl alcohol solvent. The residence time of the strand with the solution of burning rate deterrent is controlled at 2.1 seconds (Example 1) and 4.1 seconds (Example 2). The resulting deterrent coated propellant strands are immediately passed through a cutting device and the cut grains are washed with water, dried, glazed and packaged (the latter three are finishing operations). Washings take place immediately after cutting. For evaluation purposes propellant of the same composition is prepared without any burning rate deterrent coating (Control 1).

TABLE 1

| Propellant Composition Constituent, percent | Control Uncoated Propellant | Ex. 1 | Ex. 2 |
|---|---|---|---|
| Nitrocellulose (12.19% N) | 28.41 | 28.39 | 28.40 |
| Nitroglycerin | 18.84 | 19.01 | 18.77 |
| Nitroguanidine | 51.29 | 51.14 | 51.27 |
| Ethyl Centralite* | 1.46 | 1.46 | 1.46 |
| Potassium Sulfate (added) | 0.50 | 0.47 | 0.48 |
| TOTAL | 100.50 | 100.47 | 100.48 |
| Ethyl Centralite Deterrent Coating | — | 0.53 | 0.34 |
| Heat of Explosion, cal/g | 935.7 | 918.5 | 920.9 |
| Gravimetric Density, g/cc | 0.815 | 0.795 | 0.805 |
| Total Volatiles | 0.15 | 0.17 | 0.14 |
| Propellant Dimensions | | | |
| Length, inch (L) | 0.146 | 0.151 | 0.150 |
| Diameter, inch (D) | 0.1256 | 0.1247 | 0.1232 |
| Perf Diameter, inch (d) | 0.0167 | 0.0154 | 0.0143 |
| Web, inch | | | |
| Inner | 0.0199 | 0.0209 | 0.0222 |
| Outer | 0.0182 | 0.0192 | 0.0188 |
| Average | 0.0190 | 0.0201 | 0.0205 |
| Web Difference, percent | −8.57 | −8.72 | −16.72 |
| L:D | 1.16 | 1.21 | 1.22 |
| D:d | 7.52 | 8.11 | 8.60 |
| Relative Quickness, percent | | | |
| Temp., °F. | | | |
| +90 | 113.76 | 110.87 | 109.79 |
| −40 | 109.61 | 110.87 | 106.61 |
| Relative Force, percent | | | |
| Temp., °F. | | | |
| +90 | 106.79 | 104.85 | 105.52 |
| −40 | 104.72 | 103.91 | 104.03 |

*Propellant content - not deterrent coating

Figure 2:
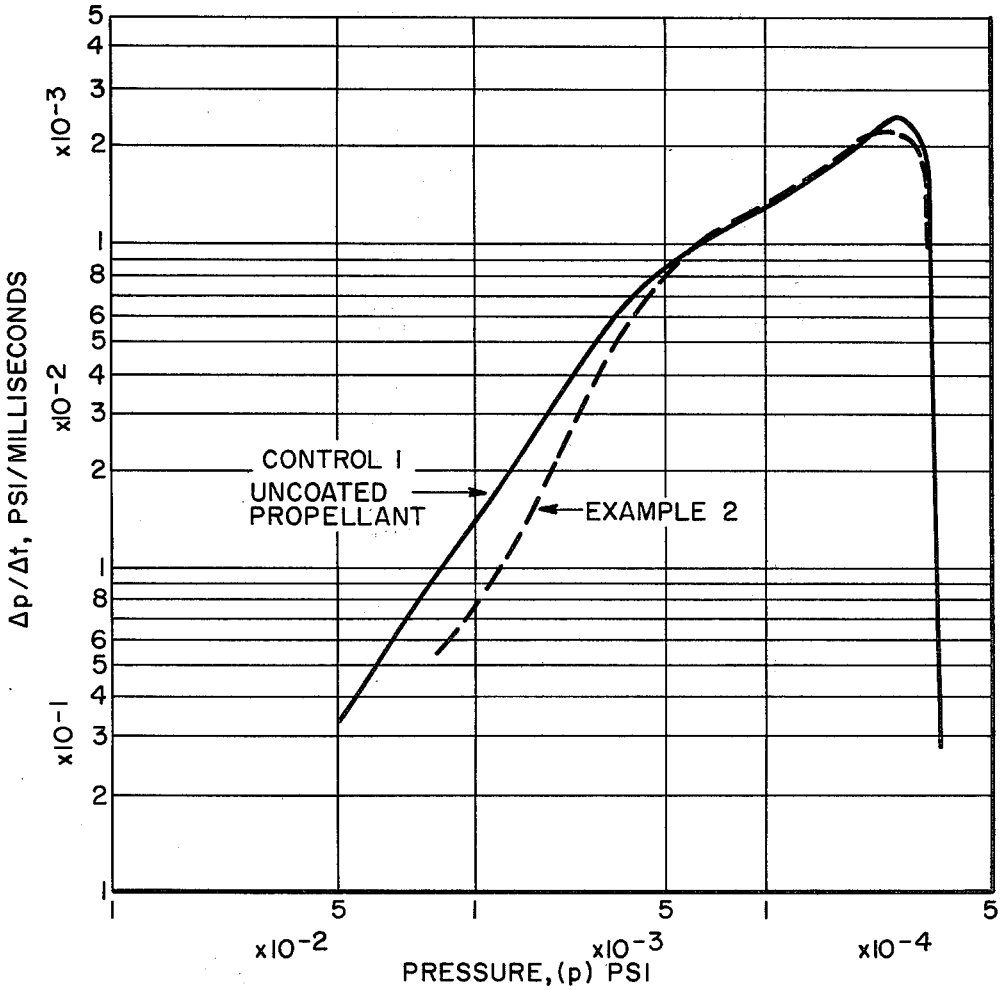

A graph of the burning rate of one of the propellant powders which is deterrent coated in accordance with the process of this invention (Example 2) is illustrated in FIG. 2 in which the change in pressure (p) per millisecond (t) is plotted versus pressure. The control propellant powder burning rate is illustrated in FIG. 2 for comparison purposes. It can be observed that burning rate progressivity results from the deterrent coated propellant powder prepared in accordance with the process of this invention. In particular, the curve resulting from plotting p/t vs. p has a greater slope (indicating a progressively increasing rate of pressure with time than the burning rate curve for uncoated propellant at pressures below about 7,000 p.s.i.a.

EXAMPLES 3–9

Propellant strands having the composition as set forth in Table 1 for Example 1 prior to deterrent coating are surface coated with burning rate deterrent by a separate batch coating step. The solvent-wet strands are taken directly from the extrusion operations and immersed for 5, 45 and 120 seconds in a coating solution made up of 1 part burning rate deterrent and two parts ethyl alcohol. During immersion care is taken so that only the exterior surface of the strand is contacted with the coating solution, the ends of the strands are either pinched or are not immersed in the solution of burning rate deterrent. Following immersion, the strands of propellant are removed from the bath, promptly washed with water for 30 seconds, cut to small granules and dried at 140° F. for about 24 hours. The data on the coated propellant is set forth in Table 2 below.

TABLE 2

| Example No. | Burning Rate Deterrent | Surface Coated | Coating Time (min.) | Percent Coating | Perf. Size, (inch) |
|---|---|---|---|---|---|
| Control* | Methyl Centralite | All | | 4.4 | 0.007 |
| 3 | Ethyl Centralite | Outside | 2 | 3.15 | 0.009 |
| 4 | Ethyl Centralite | Outside | 0.75 | 2.82 | 0.009 |
| 5 | Ethyl Centralite | Outside | 0.75 | 1.77 | 0.017 |
| 6 | Ethyl Centralite | Outside | 2 | 1.95 | 0.017 |
| 7 | Linear Polyester** | Outside | 0.75 | 2.2 | 0.009 |
| 8 | Ethyl | Outside Centralite | 0.06 | 1.19 | 0.009 |
| 9 | Ethyl | Outside Centralite | 0.06 | 1.11 | 0.017 |

*Single base - Canadian Ref. Lot CIL-3532

**The linear polyester has a weight average molecular weight of about 6,600; and is prepared from the following components:

| Component | Weight % |
|---|---|
| Neopentyl Glycol | 49.9 |
| Adipic Acid | 34.9 |
| Palmitic Acid | 15.0 |
| Stearic-Oleic Acid | 0.3 |

The deterrent coated propellant of each of Examples 3–9 is evaluated in gun tests and gun pressures are recorded. The results of these tests are set forth in Table 3.

TABLE 3

| Example No. | Velocity Ft./Sec. | Pressure K, psi | Charge Weight (grams) |
|---|---|---|---|
| Control* | 3074 | 48.3 | 148 |
| 3 | 2450 | 22.4 | 154 |
| 4 | 2637 | 26.4 | 154 |
| 5 | — | — | — |
| 6 | 2938 | 40.6 | 148 |
| 7 | 2664 | 28.0 | 154 |
| 8 | 2834 | 36.3 | 154 |
| 9 | 3072 | 48.8 | 148 |

*Single Base - Canadian Reference Lot CIL-3532

EXAMPLES 10–15

Following the procedure of Examples 3–9, a strand of solvent-wet triple base propellant composition is immersed in a mixture of linear polyester and ethyl alcohol and then passed to a cutting machine, cut into granules of powder, washed with water and dried. The total time elapsed from immersion of the propellant strand into the mixture of linear polyester burning rate deterrent and ethyl alcohol until the propellant was washed with water to remove ethyl alcohol and burning rate deterrent that had not penetrated into the propellant was about 10 seconds. The powder granules were coated with about 1.3% by weight of burning rate deterrent as a result of this deterrent coating operation. After drying, varying quantities of these granules were charged to a test gun for firing. The gun operated satisfactorily employing the deterrent coated propellant of this invention. Results of these test firings of this propellant in a gun are set forth in Table 4 below.

TABLE 4

| Example No. | Velocity Ft./Sec. | Pressure K, psi | Charge Weight (grams) |
|---|---|---|---|
| 10 | 2746 | 34.2 | 120 |
| 11 | 2811 | 35.1 | 125 |
| 12 | 2885 | 46.6 | 130 |
| 13 | 3100 | 52.7 | 135 |
| 14 | 3137 | 52.7 | 140 |
| 15 | 3294 | 70.4 | 145 |

EXAMPLES 16–20

Following the procedure of Examples 3–9, a strand of solvent-wet triple base propellant is immersed in a solution of dimethyl (1 part) diphenyl urea (burning rate deterrent) in ethyl alcohol (2 parts), and then passed to a cutting machine where the strand is cut into small granules and the granules are marked with water at the face of the cutting machine. The total time elapsed from immersion of the propellant strand in the solution of burning rate deterrent until the propellant is washed with water is about 10 seconds. The propellant granules contain about 0.25% by weight of deterrent. After drying, varying quantities of granules are charged to a test gun for firing. Results of the test firings, which were successful, are set forth in Table 5 below.

TABLE 5

| Example No. | Velocity Ft./Sec. | Pressure K, psi | Charge Weight (grams) |
|---|---|---|---|
| 16 | 2731 | 33.7 | 120 |
| 17 | 2921 | 44.5 | 125 |
| 18 | 3001 | 50.4 | 130 |
| 19 | 3038 | 50.5 | 135 |
| 20 | 3150 | 59.5 | 140 |

I claim:

1. A process for preparation of progressive burning propellant granules from strands of propellant prior to drying of said strands to remove processing solvents, the propellant composition of said strands comprising nitrocellulose, energetic nitrate ester plasticizer and nitroguanidine, said process comprising:

(a) contacting the exterior surface of the solvent-wet propellant strand with a nonaqueous mixture comprising a burning rate deterrent and a solvent, said burning rate deterrent being selected from dimethyl diphenyl urea, diethyl diphenyl urea, ethylene dimethacrylate, lead-2-ethyl hexoate and linear polyesters capable of diffusing into said propellant strand, said polyesters having a weight average molecular weight of from about 1,500 to about 30,000, a melting point not exceeding 190° F. and being substantially nonmigrating within said propellant strand at temperatures below 150° F., and continuing contact for a time sufficient to permit the burning rate deterrent to penetrate the surface of said strand, (b) promptly washing excess mixture of burning rate deterrent and solvent from the surface of said strand with water and cutting said strand of deterrent coated propellant into granules, the order of the steps of washing and cutting being interchangeable provided washing is conducted promptly, and (c) drying the resulting deterrent coated granules.

2. The process of claim 1 in which from about 0.2% to about 4% by weight of burning rate deterrent, based on the weight of the propellant, is coated on the exterior surface of the propellant granules.

3. The process of claim 1 in which the solvent for the burning rate deterrent is selected from methyl alcohol, ethyl alcohol, n-propyl alcohol, isopropyl alcohol, n-butyl alcohol and isobutyl alcohol.

4. The process of claim 3 in which the solvent is ethyl alcohol.

* * * * *